US009095212B2

(12) United States Patent
Yamamoto

(10) Patent No.: US 9,095,212 B2
(45) Date of Patent: Aug. 4, 2015

(54) STORAGE CASE

(71) Applicant: SHINWA CO., LTD., Niigata (JP)

(72) Inventor: Kazunobu Yamamoto, Niigata (JP)

(73) Assignee: SHINWA CO., LTD., Niigata (JP)

( * ) Notice: Subject to any disclaimer, the term of this patent is extended or adjusted under 35 U.S.C. 154(b) by 0 days.

(21) Appl. No.: 14/322,212

(22) Filed: Jul. 2, 2014

(65) Prior Publication Data

US 2015/0008814 A1 Jan. 8, 2015

(30) Foreign Application Priority Data

Jul. 4, 2013 (JP) ..... 2013-140775

(51) Int. Cl.
*A47B 88/04* (2006.01)
*A47B 87/02* (2006.01)
*A47B 88/00* (2006.01)

(52) U.S. Cl.
CPC ..... *A47B 88/0455* (2013.01); *A47B 87/0276* (2013.01); *A47B 87/0292* (2013.01); *A47B 88/0003* (2013.01); *A47B 2210/19* (2013.01)

(58) Field of Classification Search
CPC ..... A47B 88/0455; A47B 88/04; A47B 88/0407; A47B 2088/0474; A47B 88/08; A47B 2210/0059; A47B 2088/0488; A47B 2210/0056; A47B 2210/091; A47B 88/0451; A47B 87/0292; A47B 2210/19; A47B 88/047; A47B 88/06; A47B 2210/0091; A47B 2210/0064; A47B 2210/0045; A47B 2210/0043; A47B 2210/0021; A47B 88/14
USPC ..... 312/334.27, 246, 334.7, 108, 107, 312/330.1, 334.28, 334.14, 334.6, 111
See application file for complete search history.

(56) References Cited

U.S. PATENT DOCUMENTS

| | | | | | |
|---|---|---|---|---|---|
| 1,390,377 | A | * | 9/1921 | Ohnstrand | 312/107 |
| 1,454,494 | A | * | 5/1923 | Thomas | 312/334.9 |
| 1,929,762 | A | * | 10/1933 | Ulrich | 312/301 |
| 2,099,148 | A | * | 11/1937 | Tobey | 312/334.13 |
| 2,319,283 | A | * | 5/1943 | Zalkind | 384/18 |
| 2,617,693 | A | * | 11/1952 | Stafford | 384/17 |
| 3,243,247 | A | * | 3/1966 | Knape | 312/333 |
| 3,289,044 | A | * | 11/1966 | Ginsberg | 361/727 |
| 3,697,140 | A | * | 10/1972 | Livingston | 384/19 |
| 3,826,554 | A | * | 7/1974 | Cornell | 312/348.1 |
| 4,061,375 | A | * | 12/1977 | Mertes | 384/21 |
| 4,285,560 | A | * | 8/1981 | Miller | 312/331 |
| 4,447,095 | A | * | 5/1984 | Fielding | 384/19 |
| 4,558,908 | A | * | 12/1985 | Rock et al. | 384/19 |
| 4,564,248 | A | * | 1/1986 | Grass | 384/19 |
| 4,659,237 | A | * | 4/1987 | Rapp | 384/19 |
| 4,856,855 | A | * | 8/1989 | Hasuike | 312/111 |
| 4,927,216 | A | * | 5/1990 | Boda | 312/334.12 |
| 4,953,991 | A | * | 9/1990 | Rock | 384/19 |

(Continued)

*Primary Examiner* — Daniel J Troy
*Assistant Examiner* — Hiwot Tefera
(74) *Attorney, Agent, or Firm* — Saul Ewing LLP

(57) ABSTRACT

A storage case includes a frame, a top plate, and a drawer. The top plate covers an open upper side of the frame. The drawer is movable through an open front side of the frame. A bottom plate of the frame includes grooved rails and guide walls. The grooved rails are formed at left and right sides of the bottom plate. The guide walls are formed at left and right sides of the inner surface of the bottom plate so that the left and right side plates of the drawer are slidable along the guide walls. The drawer includes guide projections formed at rear left and right sides of the bottom plate. The guide projections are fitted to the grooved rails so that the guide projections are movable along the grooved rails.

2 Claims, 14 Drawing Sheets

(56) References Cited

U.S. PATENT DOCUMENTS

| | | | | |
|---|---|---|---|---|
| 4,961,648 | A * | 10/1990 | Rock | 384/19 |
| 5,016,946 | A * | 5/1991 | Reznikov et al. | 312/108 |
| 5,201,575 | A * | 4/1993 | Stolzel | 312/323 |
| 5,785,400 | A * | 7/1998 | Grieser et al. | 312/334.12 |
| 6,086,176 | A * | 7/2000 | Aoyama | 312/286 |
| 6,193,340 | B1 * | 2/2001 | Schenker et al. | 312/265.5 |
| 6,585,336 | B2 * | 7/2003 | Munday et al. | 312/334.4 |
| 6,902,245 | B1 * | 6/2005 | Hoeppner | 312/334.46 |
| 8,876,231 | B2 * | 11/2014 | Chen | 312/334.6 |
| 2004/0263031 | A1 * | 12/2004 | Irizarry | 312/330.1 |
| 2005/0046317 | A1 * | 3/2005 | Howard | 312/334.27 |
| 2008/0036346 | A1 * | 2/2008 | Kobayashi | 312/334.1 |
| 2009/0302725 | A1 * | 12/2009 | Rogers et al. | 312/257.1 |
| 2010/0253194 | A1 * | 10/2010 | Wang | 312/334.1 |

* cited by examiner

STORAGE CASE

CROSS-REFERENCE TO RELATED APPLICATIONS

This application is based on and claims priority to Japanese Application No. 2013-140775, filed Jul. 4, 2013, the entire contents of which being fully incorporated herein by reference.

BACKGROUND OF THE INVENTION

The present invention relates to a storage case used in a typical household to organize and store clothing and small articles.

A known storage case generally includes a frame, a top plate, and a drawer (refer to, for example, Japanese Registered Utility Model No. 3175827). The frame is made of a synthetic resin and includes an open front side and an open upper side. The top plate is made of a synthetic resin and covers the upper side of the frame. The drawer is made of a synthetic resin, includes an open upper side, and may be pulled out of the frame and pushed into the frame through the open front side.

The drawer is set on a bottom plate of the frame. Thus, depending on the weight of the contents in the drawer, a large sliding friction may be produced between the drawer and the frame. In such a case, it may be difficult to smoothly move the drawer out of and into the frame.

SUMMARY OF THE INVENTION

One aspect of the present invention is a storage case including a frame, a top plate, and a drawer. The frame is made of a synthetic resin and includes a bottom plate, left and right side plates, a rear plate, an open front side, and an open upper side. The top plate is made of a synthetic resin. The top plate covers the upper side of the frame. The drawer is made of a synthetic resin and includes a bottom plate, a front plate, left and right side plates, a rear plate, and an open upper opening. The drawer is movable through the open front side of the frame. The bottom plate of the frame includes grooved rails and guide walls. The grooved rails are respectively formed at left and right sides of an inner surface of the bottom plate. The guide walls are respectively formed at left and right sides of the inner surface of the bottom plate outward from the corresponding grooved rails so that outer surfaces of the left and right side plates of the drawer are slidable along the guide walls. The bottom plate of the drawer includes guide projections formed at rear left and right sides of an outer surface of the bottom plate. The guide projections are respectively fitted to the left and right grooved rails so that the guide projections are movable along the left and right grooved rails.

A further aspect of the present invention is a storage case including a plurality of frames, a top plate, and a drawer. The frames are stackable upon one another. The frames are each made of a synthetic resin and include a bottom plate, left and right side plates, a rear plate, an open front side, and an open upper side. The top plate is made of a synthetic resin. The top plate covers the upper side of an uppermost one of the frames. The drawer is made of a synthetic resin and includes a bottom plate, a front plate, left and right side plates, a rear plate, and an open upper opening. The drawer is movable through the open front side of each of the frames. The bottom plate of each of the frames includes grooved rails and guide walls. The grooved rails are respectively formed at left and right sides of an inner surface of the bottom plate of each of the frames. The guide walls are respectively formed at left and right sides of the inner surface of the bottom plate of each of the frames outward from the corresponding grooved rails so that outer surfaces of the left and right side plates of the drawer are slidable along the guide walls. The bottom plate of each of the drawers includes guide projections formed at rear left and right sides of an outer surface of the bottom plate, and the guide projections are respectively fitted to the left and right grooved rails so that the guide projections are movable along the left and right grooved rails.

In the storage case of the above aspects, each of the grooved rails includes a groove surface. The groove surface includes pits, a middle portion, a peak, a slope, and a horizontal portion. The pits are respectively located at a front side and a rear side of the grooved rails in a moving direction of the drawer. The middle portion extends along the groove surface between the pit at the front side and the pit at the rear side. The peak is located in the middle portion. The slope extends along the groove surface from the pit at the front side to the peak and ascends from the front side toward the rear side. The horizontal portion extends along the groove surface from the peak to the pit at the rear side. When the drawer is pushed into the frame, each of the guide projections moves out of the pit at the front side in the groove surface of the corresponding one of the groove rails, ascends along the slope, passes by the peak, moves horizontally along the horizontal portion, and then falls into the pit at the rear side. When the drawer is pulled out of the frame, each of the guide projections moves out of the pit at the rear side in the groove surface of the corresponding one of the groove rails, moves horizontally along the horizontal portion, passes by the peak, descends along the slope, and then falls into the pit at the front side.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

Figure 13:
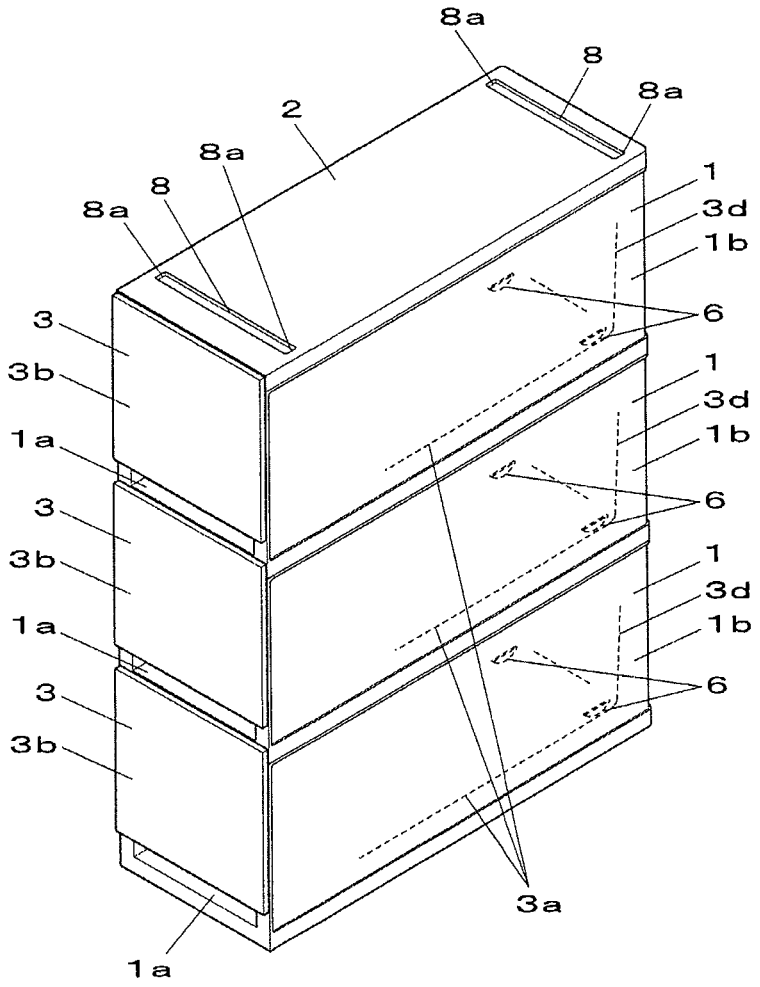
FIG. 13 is a perspective view showing a second embodiment of the present invention.
Figure 14:
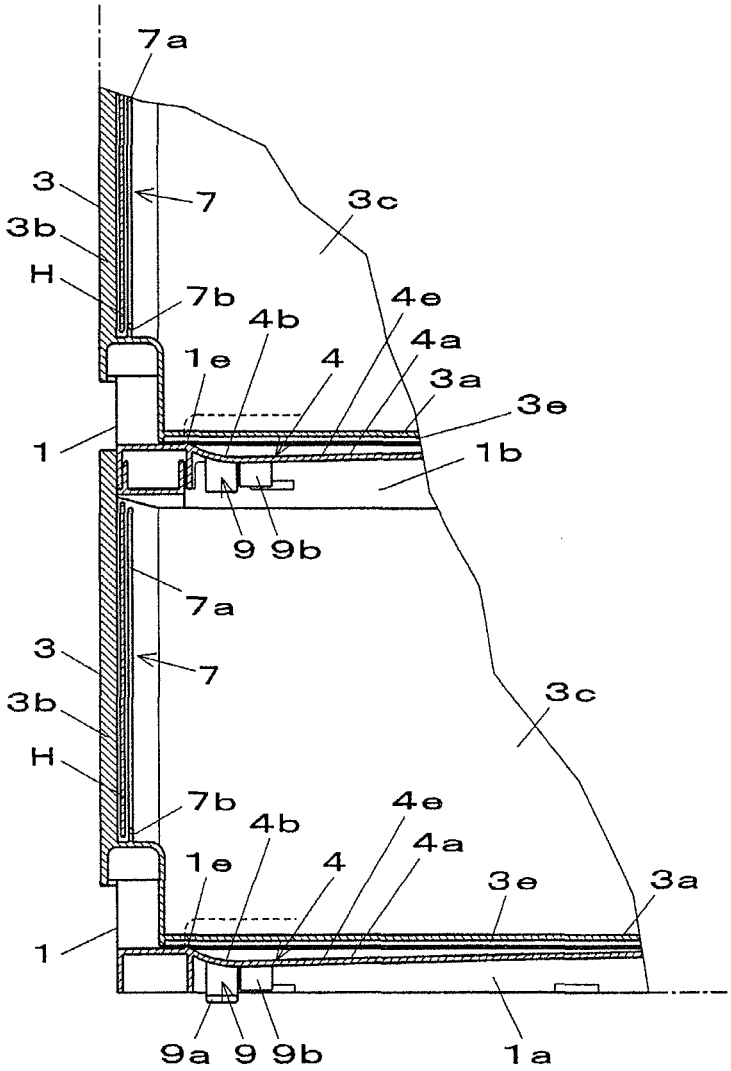
FIG. 14 is a partial, cross-sectional view showing the second embodiment of the present invention.

Embodiments of the present invention will now be described with reference to FIGS. 1 to 14. FIGS. 1 to 12 show a first embodiment, and FIGS. 13 and 14 show a second embodiment.

Figure 1:
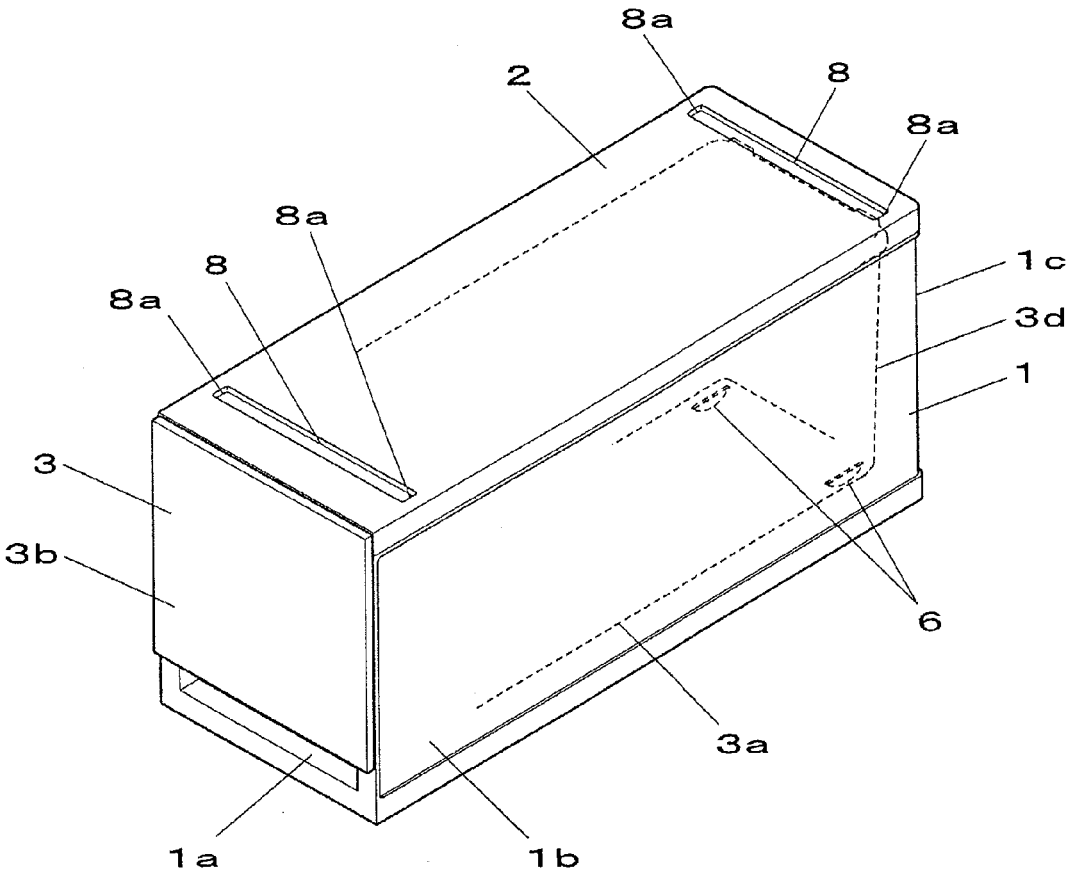
FIG. 1 is a perspective view showing a first embodiment of the present invention.
Figure 2:
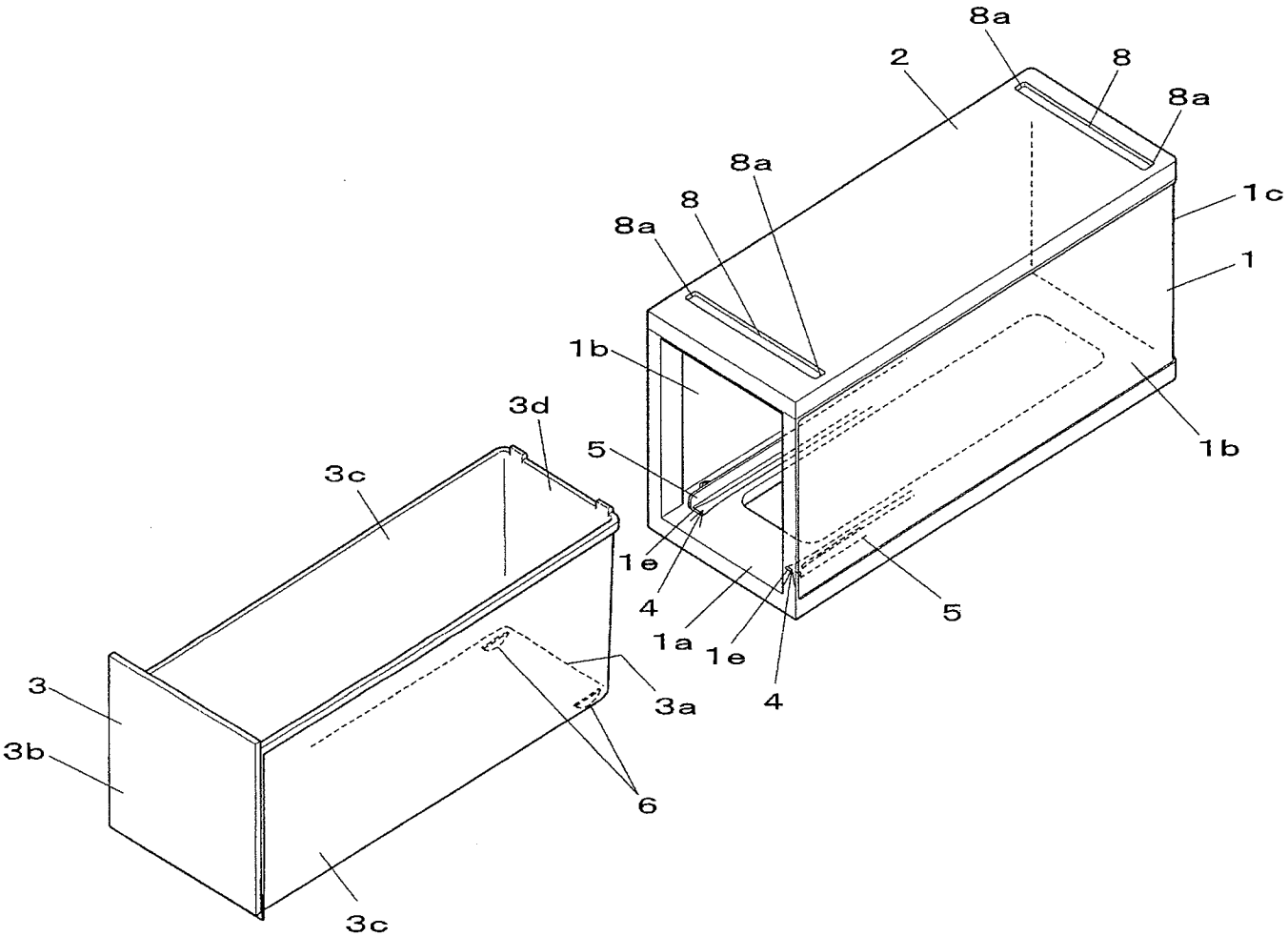
FIG. 2 is an exploded perspective view showing the first embodiment of the present invention.
Figure 3:
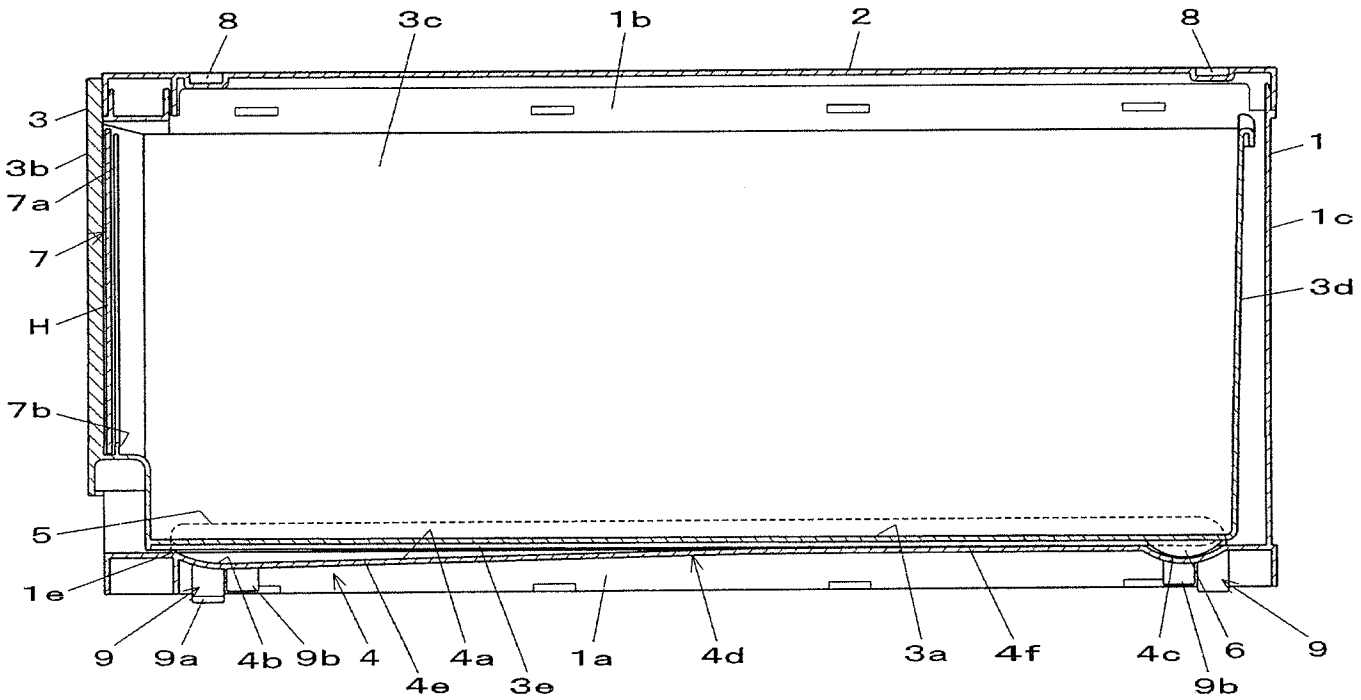
FIG. 3 is a cross-sectional view showing the first embodiment of the present invention.
Figure 4:
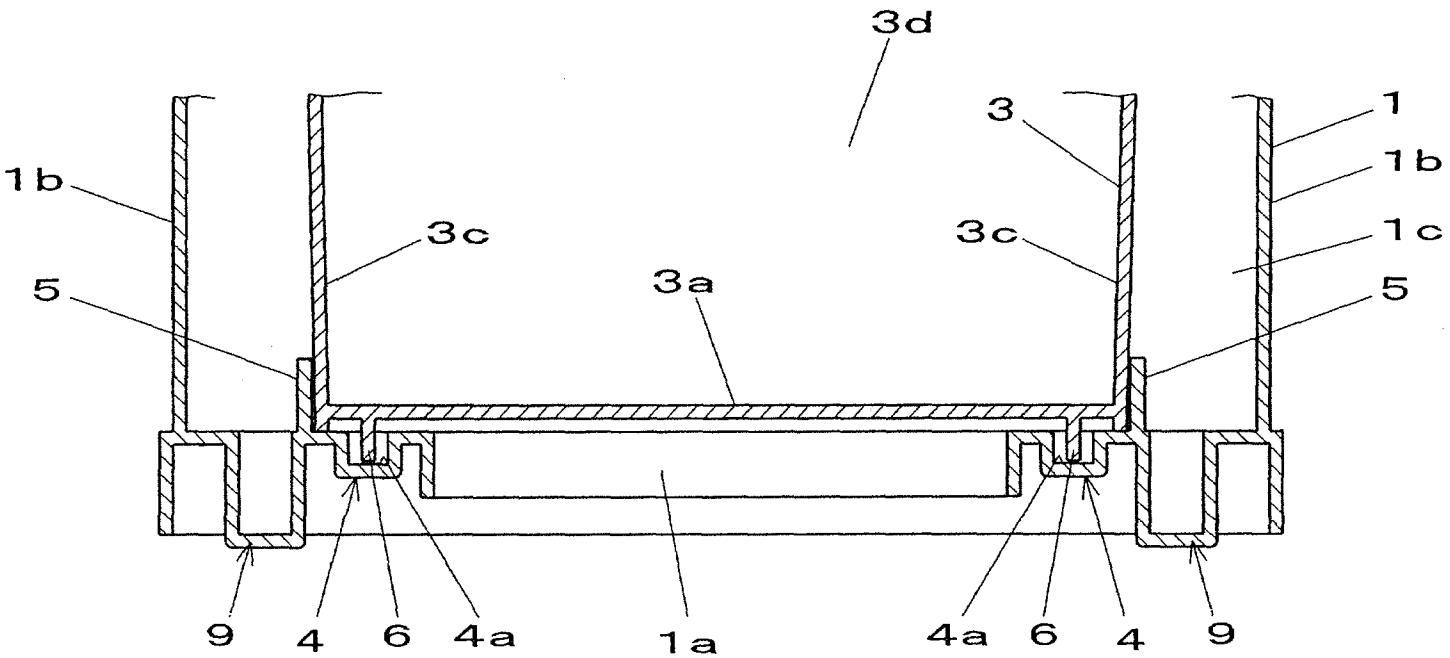
FIG. 4 is a partial, cross-sectional view showing the first embodiment of the present invention.

In the first embodiment, referring to FIGS. 1 and 2, a frame 1, which is made of a synthetic resin, includes a bottom plate 1*a*, left and right side plates 1*b*, and a rear plate 1*c*. Further, the frame 1 includes an open front side and an open upper side.

A top plate 2, which is made of a synthetic resin, covers the upper side of the frame 1. The top plate 2 is attached in a removable manner to the frame 1 using hooks and holes that are engaged with each other.

As shown in FIGS. 1 and 2, a drawer 3, which is container-like and made of a synthetic resin, includes an open upper side. Further, the drawer 3 includes a bottom plate 3*a*, a front plate 3*b*, left and right side plates 3*c*, and a rear plate 3*d*.

As shown in FIGS. 2, 3, 4, 5, and 7, a grooved rail 4 extends along each of the left and right sides of the inner surface of the bottom plate 1*a* in the frame 1. Each grooved rail 4 extends in the moving direction T of the drawer 3.

As shown in FIGS. 2, 3, 4, and 5, a guide wall 5 extends along each of the left and right sides of the inner surface of the bottom plate 1*a* in the frame 1 at the outer side of the corresponding grooved rail 4. The guide wall 5 is formed to allow for the outer surface of the corresponding side plate 3*c* of the drawer 3 to slide along the guide wall 5. A protrusion 3*e* projects from each of the left and right sides of the bottom surface of the drawer 3. The frame 1 includes left and right projections 1*e* along which the left and right protrusions 3*e* of the drawer 3 slides when moving the drawer 3 out of and into the frame 1.

Figure 5:
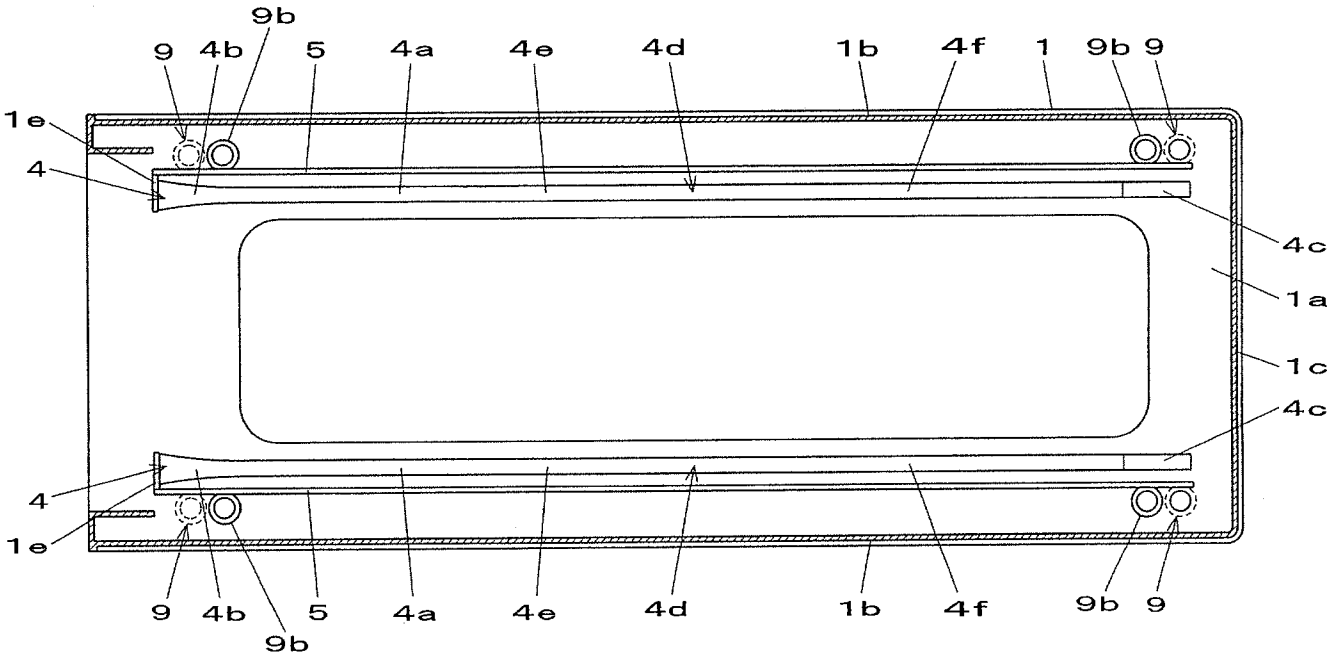
FIG. 5 is a partial, cross-sectional plan view showing the first embodiment of the present invention.
Figure 6:
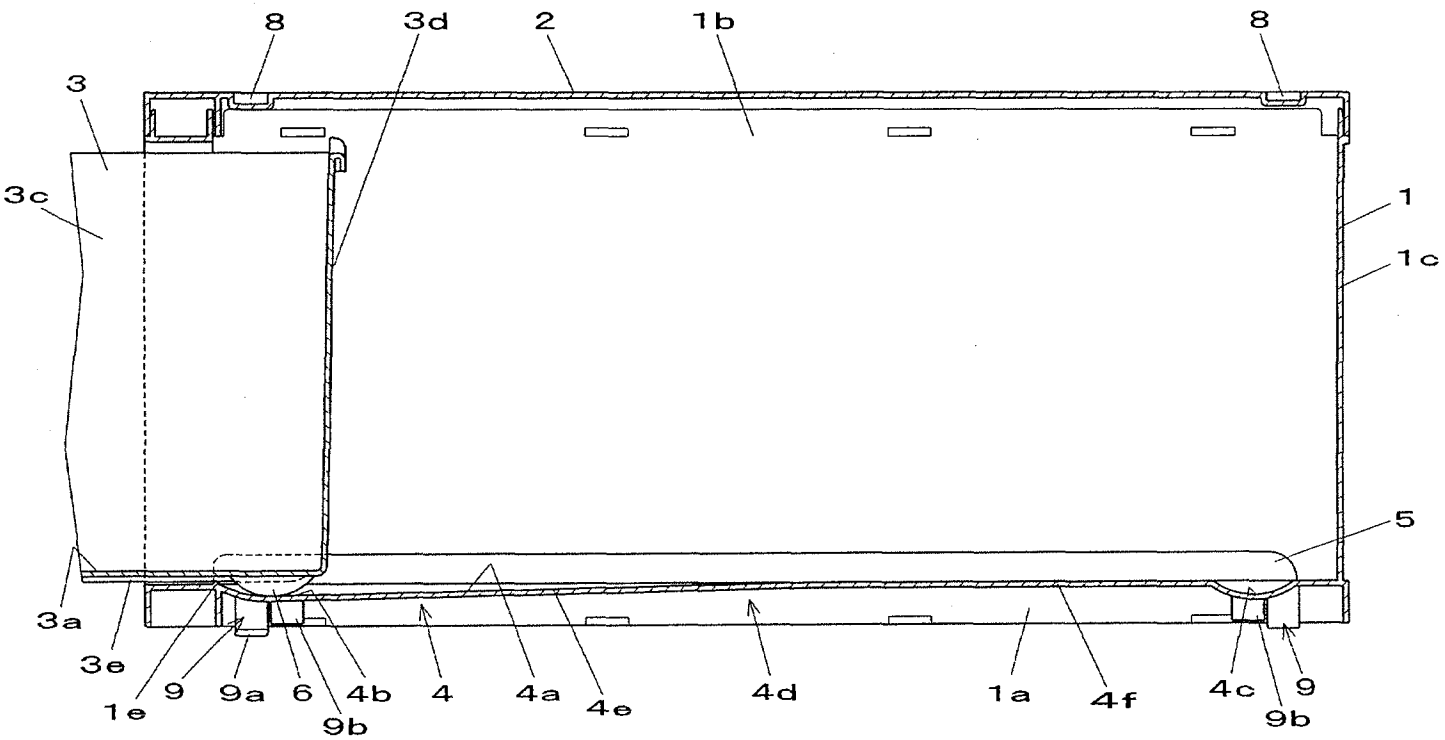
FIG. 6 is a partial, cross-sectional view showing the first embodiment of the present invention.
Figure 7:
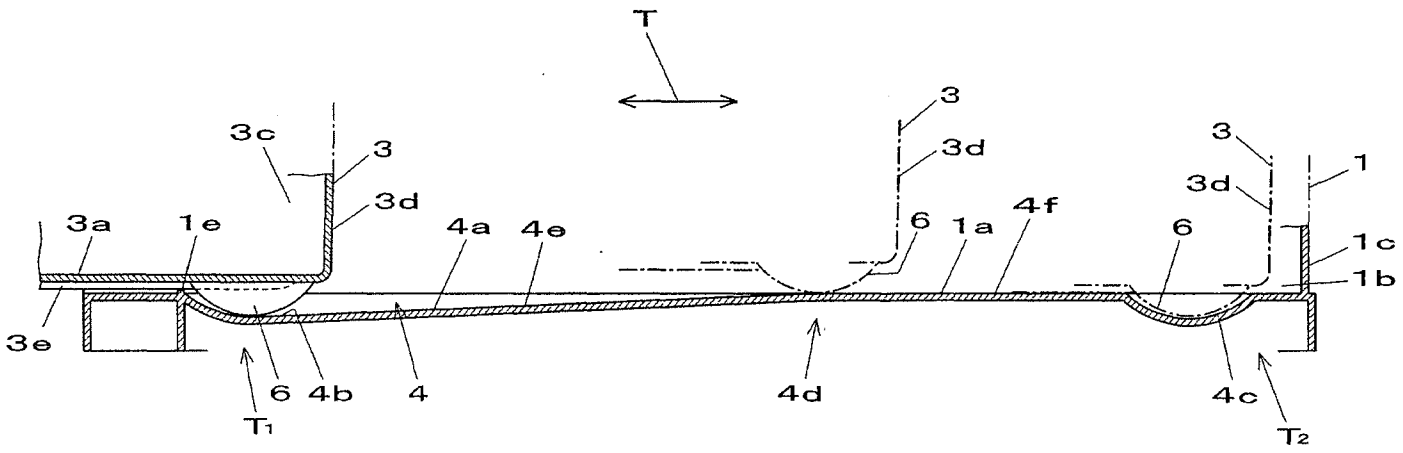
FIG. 7 is a schematic cross-sectional view showing the first embodiment of the present invention.

As shown in FIGS. 5, 6, and 7, a guide projection 6 projects from each of the left and right sides in the rear portion of the outer surface of the bottom plate 3*a* of the drawer 3. The left and right guide projections 6 are fitted in a slidable manner to the corresponding grooved rails 4. In this case, each guide projection 6 is semicircular.

As shown in FIGS. 5, 6, and 7, each grooved rail 4 includes a groove surface 4*a*. A front side T1 of the groove surface 4*a* includes a pit 4*b*, and a rear side T2 of the groove surface 4*a* includes a pit 4*c*. A peak 4*d* is formed in the groove surface 4*a* between the pits 4*b* and 4*c*. The groove surface 4*a* from the pit 4*b* at the front side T1 to the peak 4*d* forms a slope 4*e* that ascends from the front side T1 to the rear side T2. The groove surface 4*a* from the peak 4*d* to the rear pit 4*c* is a horizontal portion 4*f*. When moving the drawer 3 into the frame 1, the guide projection 6 is pushed out of the front pit 4*b* and moved upward along the slope 4*e*. After passing by the peak 4*d*, the guide projection 6 is horizontally moved along the horizontal portion 4*f* until falling into the rear pit 4*c*. When moving the drawer 3 out of the frame 1, the guide projection 6 is pulled out of the rear pit 4*c* and moved along the horizontal portion 4*f*. After passing by the peak 4*d*, the guide projection 6 is moved downward along the slope 4*e* until falling into the front pit 4*b*.

Figure 8:
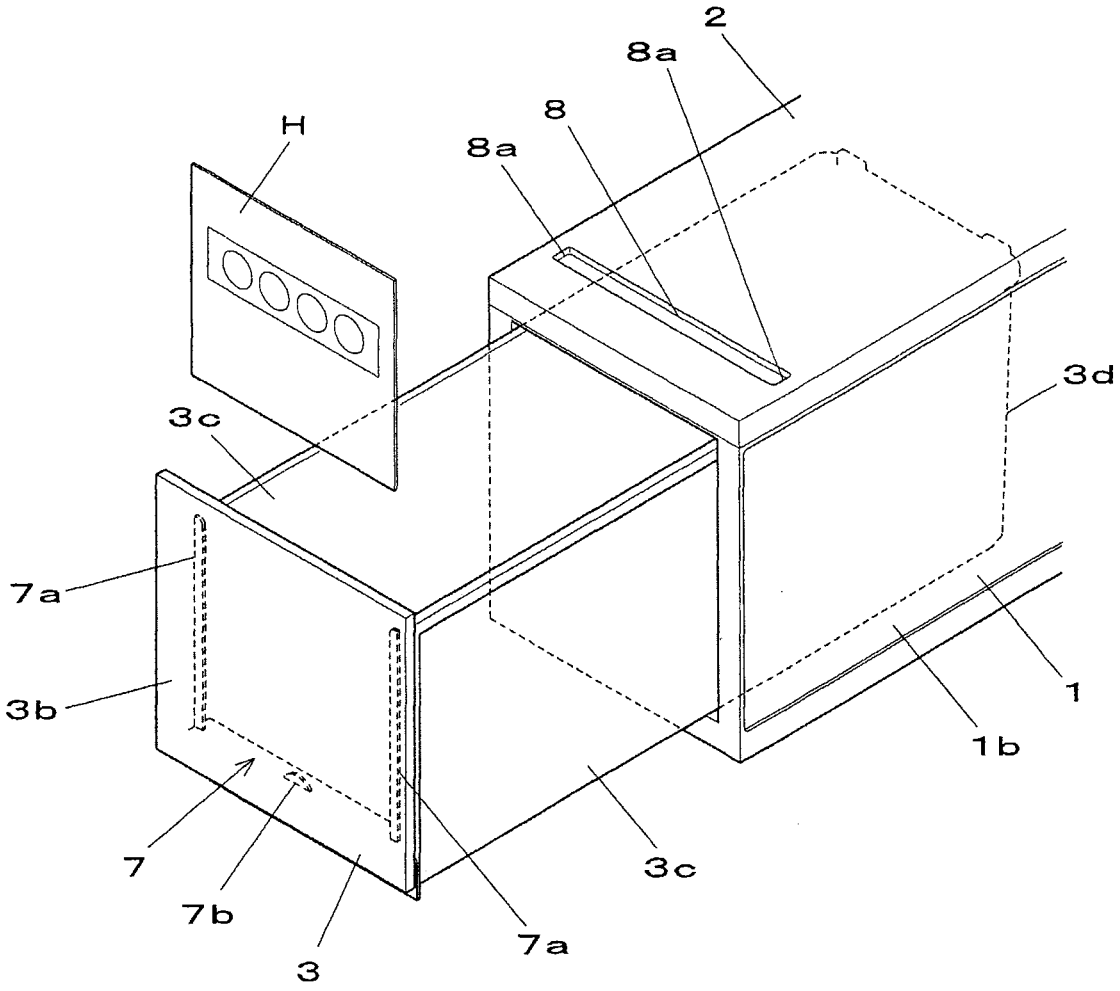
FIG. 8 is a partial perspective view showing the first embodiment of the present invention.
Figure 9:
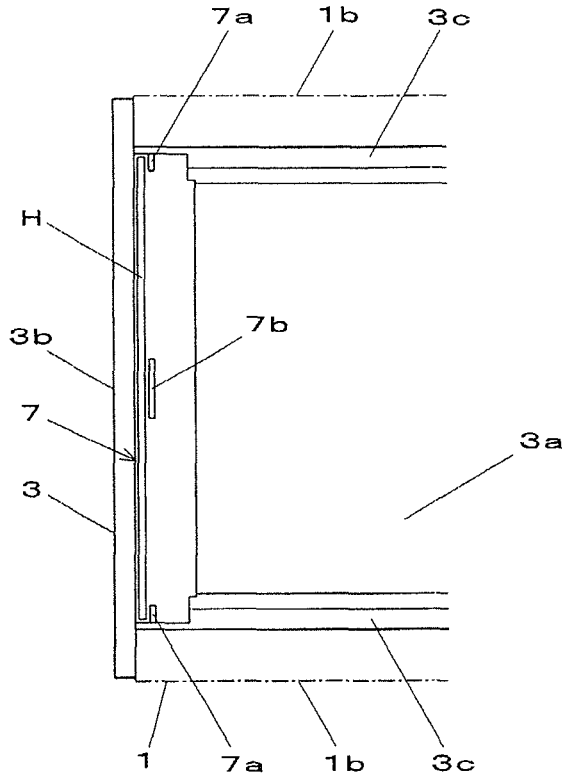
FIG. 9 is a partial plan view showing the first embodiment of the present invention.

Referring to FIGS. 8 and 9, the front side of the drawer 3 includes a pocket 7, which may be used to accommodate a replaceable index H, such as a label or a card that indicates the contents of the drawer 3. Left and right holding walls 7*a* are formed on the front inner surfaces of the left and right side plates 3*c* to hold the rear left and right sides of the index H. A holding tab 7*b* is formed on the front inner surface of the bottom plate 3*a* to hold the rear lower side of the index H.

Figure 10:
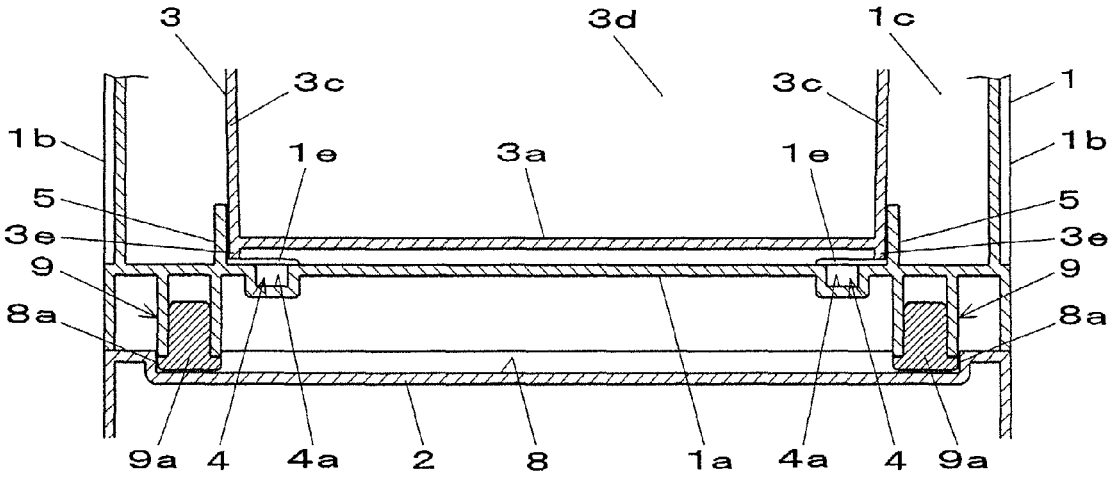
FIG. 10 is a partial, cross-sectional view showing the first embodiment of the present invention.
Figure 11:
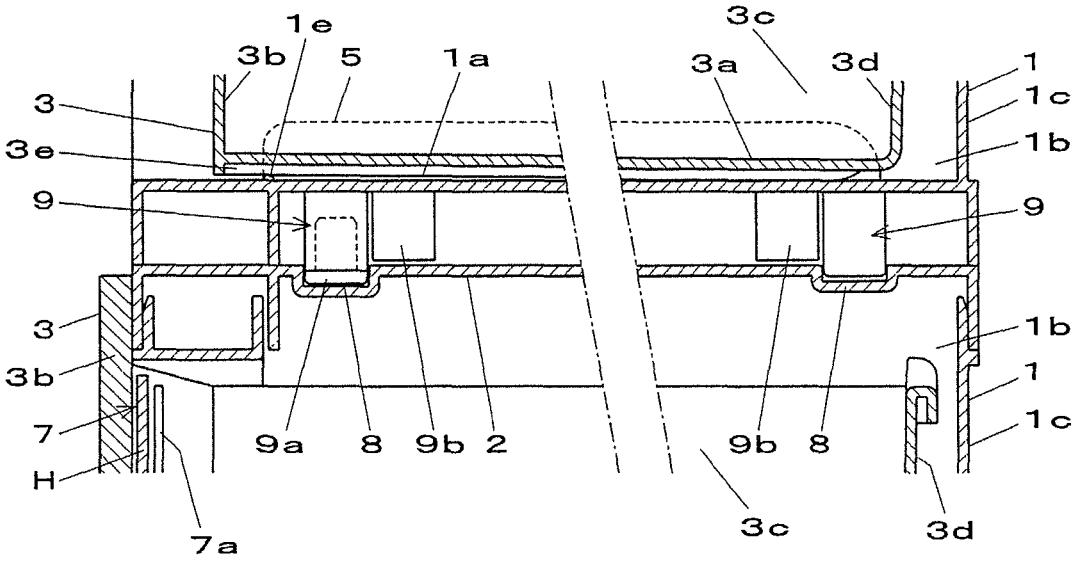
FIG. 11 is a partial, cross-sectional view showing the first embodiment of the present invention.
Figure 12:
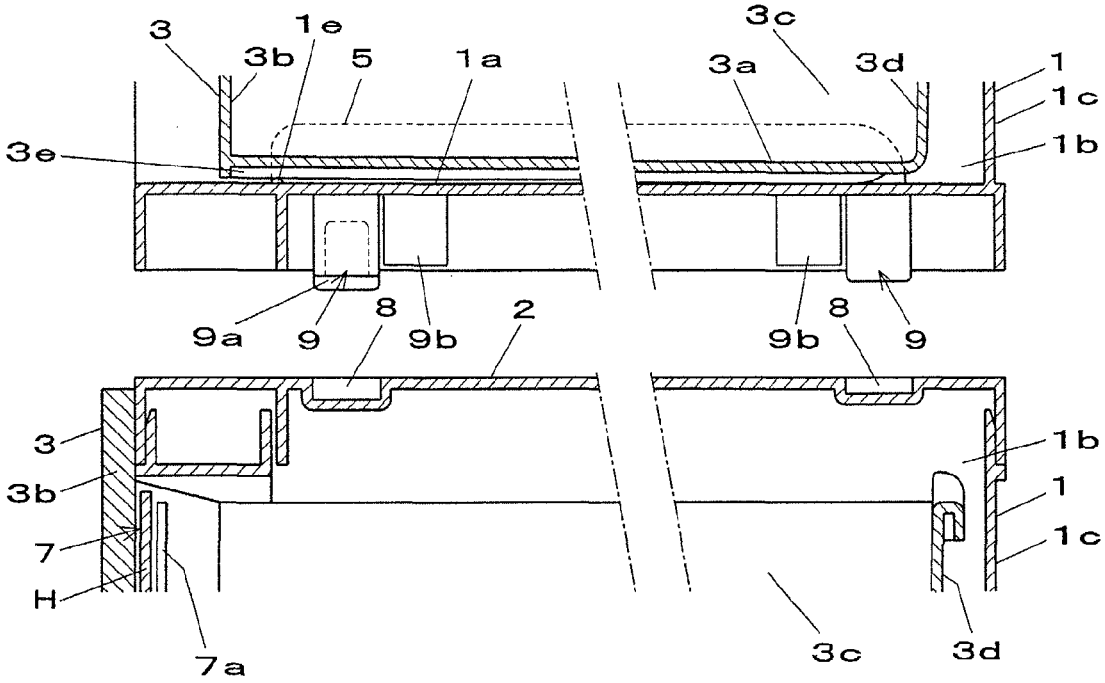
FIG. 12 is a partial, cross-sectional view showing the first embodiment of the present invention.

Referring to FIGS. 10, 11, and 12, a fitting recess 8 is formed in each of the front side and rear side of the upper surface of the top plate 2. Each fitting recess 8 is an elongated groove including two ends 8*a*. A fitting projection 9 is formed in each of the front side and rear side of the outer surface of the bottom plate 1*a* of the frame 1. The fitting projections 9 may be fitted in a movable manner into the fitting recesses 8 of another frame 1. In this case, a rubber attachment 9*a* is attached to the fitting projection 9. Caster supports 9*b* are arranged next to the front and rear fitting projections 9.

Referring to FIGS. 1 and 2, the drawer 3 is pulled out of and pushed into the frame 1 through the front opening to store clothing and small articles. In this case, as shown in FIGS. 2 to 5, the grooved rails 4 are formed in the left and right sides of the inner surface of the bottom plate 1*a* of the frame 1. The guide walls 5 are formed on the left and right sides of the inner surface of the bottom plate 1*a* at the outer sides of the grooved rails 4. The left and right side plates 3*c* of the drawer 3 are slidable along the guide walls 5. The guide projections 6 are formed on the left and right sides in the rear portion of the outer surface of the bottom plate 3*a* of the drawer 3. The guide projection 6 can be fitted into the grooved rails 4 in a slidable manner. Accordingly, referring to FIGS. 3, 4, and 6, when the drawer 3 is pulled out of and pushed into the frame 1, the left and right side plates 3*c* of the drawer 3 are moved along and guided by the guide walls 5 as the guide projections 6 slide along the grooved rails 4. This allows for the drawer 3 to be smoothly moved out of and into the frame 1 and improves convenience.

Referring to FIGS. 6 and 7, the pits 4*b* and 4*c* are formed in the groove surface 4*a* of each grooved rail 4 at the front side T1 and the rear side T2 with respect to the moving direction T of the drawer 3. The pits 4*b* and 4*c* receive the corresponding guide projections 6. The groove surface 4*a* includes the peak 4*d*, which is located between the pit 4*b* at the front side T1 and the pit 4*c* at the rear side T2. Further, the groove surface 4*a* includes the slope 4*e* extending from the pit 4*b* at the front side T1 to the peak 4*d* and ascending from the front side T1 to the rear side T2. The groove surface 4*a* from the peak 4*d* to the rear pit 4*c* includes the horizontal portion 4*f*. When pushing the drawer 3 into the frame 1, the guide projections 6 move out of the pits 4*b* at the front side T1, ascend along the slopes 4*e*, pass by the peaks 4*d* at the middle portion, slide horizontally along the horizontal portion 4*f*, and fall into the pits 4*c* at the rear side T2. When pulling the drawer 3 out of the frame 1, the guide projections 6 move out of the pits 4*c* at the rear side T2, slide horizontally along the horizontal portion 4*f*, pass by the peaks 4*d* at the middle portion, descend along the slope 4*e*, and fall into the pits 4*b* at the front side T1.

Accordingly, when pushing the drawer 3 into the frame 1, the user pushes the drawer 3 with a relatively strong force as the guide projections 6 move out the pits 4*b* at the front side T1 and advance to the middle portion. Then, the user pushes the drawer 3 with a light force as the guide projections 6 move horizontally until the guide projections 6 fall into the pits 4*c* at the rear side T2. When pulling the drawer 3 out of the frame 1, the user pulls the drawer 3 with a light force until the projections 6 reach the middle portion. Then, the user pulls the drawer 3 with a lighter force as the guide projections 6 descend along the slopes 4*e* until the guide projections 6 fall into the pits 4*b* at the front side T1. When pushing the drawer 3 into the frame 1, the projections 6 ascend along the slopes 4*e* and then slide horizontally. This allows the user to easily move the drawer 3 into the frame 1. Further, the guide projections 6 that slide along the horizontal portions 4*f* suddenly fall into the pits 4*c* at the rear side T2. This allows the user to recognize that the drawer 3 has been completely moved into the drawer 3. Moreover, the guide projections 6 fall into the pits 4*b* or 4*c* and ensures that the drawer 3 is positioned at a fully pulled out end position or a fully pushed in end position. Further, since the guide projections 6 fall into the pits at the fully pulled out end position, the drawer 3 does not fall out of the front side of the frame 1 regardless of the condition in which the frame 1 is set, the condition of the contents stored in the drawer 3, and the application of external force. In addition, when pulling the drawer 3 out of the frame 1, the guide projections 6 descend along the slopes 4*e* from the middle portion. Thus, the drawer 3 may be easily moved. In this manner, the convenience and safety of the storage case is improved.

As shown in FIGS. 8 and 9, the front side of the drawer 3 includes the pocket 7 capable of accommodating the index H, which is replaceable. The index H is a label, a card, or the like that indicates the contents of the drawer 3. Various indexes H that are distinguishable from one another using characters, patterns, and colors may be prepared. The indexes H are selectively replaced in the pocket 7 in accordance with, for example, parent and child, male and female, or the like so that the contents of the drawer 3 can be recognized. In this case, the front plate 3*b* of the drawer 3 is formed from a transparent or translucent material so that the contents of the drawer 3 can be recognized from outside without pulling out the drawer 3. Further, the left and right holding walls 7*a* are formed on the inner front side of the left and right side plates 3*c* in the drawer 3 to hold the rear left and right ends of the index H. The holding tab 7*b* is formed on the inner front side of the bottom plate 3*a* in the frame 1 to hold the rear lower side of the index H. This ensures accommodation of the index H.

As shown in FIGS. 10, 11, and 12, the fitting recesses 8 are formed in the front and rear sides of the upper surface of the top plate 2. The fitting recesses 8 are elongated grooves, each including the two ends 8*a*. The fitting projections 9 are formed in the front and rear sides of the outer surface of the bottom plate 1*a* of the frame 1. The fitting projections 9 may be fitted in a movable manner into the fitting recesses 8 of another frame 1. Thus, when stacking a plurality of storage cases, the fitting projections 9 of one frame 1 are fitted to the fitting recesses 8 of another frame 1. This restricts displacement of the upper storage case in the front, rear, left, and right direction and increases the stacking stability. Further, when stacking storage cases having different widths, the layout of the storage cases may be freely changed in a direction orthogonal to the moving direction T of the drawer. This improves the freedom of layout so that the layout of the storage cases can be freely changed in accordance with the usage, the set positions, the stored contents, and the like. Thus, the freedom is increased for the positions where the storage cases are used and the application of the storage cases.

FIGS. 13 and 14 show a second embodiment of a storage case. In the second embodiment, a plurality of frames 1 are stacked upon one another. Like the first embodiment, the frame 1 includes the bottom plate 1*a*, the left and right side plates 1*b*, the rear plate 1*c*, and the open front and upper sides. In the second embodiment, three frames 1 are stacked. A top plate 2 covers the upper side of the uppermost frame 1. Three drawers 3 are set to be movable through the front openings of the frames 1, respectively. The grooved rails 4 are formed on the left and right sides of the inner surface of the bottom plate 1*a* in each frame 1. The guide walls 5 are formed on the left and right sides of the inner surface of the bottom plate 1*a* at the outer side of the grooved rails 4 in each of the frames 1. The left and right side plates 3*c* of each drawer 3 are slidable along the guide walls 5 of the corresponding frame 1. The guide projections 6 are formed on the rear left and right sides of the outer surface of the bottom plate 3*a* of each drawer 3 and fitted in a movable manner along the left and right grooved rails 4 of the corresponding frame 1.

The groove surface 4*a* of each grooved rail 4 includes the pits 4*b* and 4*c* at the front side T1 and the rear side T2 in the moving direction T of the corresponding drawer 3. The pits 4*b* and 4*c* can receive the corresponding guide projection 6. The peak 4*d* is formed in a middle portion between the pits 4*b* and 4*c* at the front side T1 and rear side T2 of the moving direction T. The slope 4*e* is formed in the groove surface 4*a* from the pit 4*b* at the front side T1 to the peak 4*d*. The slope 4*e* ascends from the front side T1 to the rear side T2. The horizontal portion 4*f* of the groove surface 4*a* extends from the peak 4*d* to the pit 4*c* at the rear side T2. When the corresponding drawer 3 is pushed into the frame 1, the corresponding guide projection 6 moves out of the pit 4*b* at the front side T1, ascends along the slope 4*e*, passes by the peak 4*d*, slides horizontally along the horizontal portion 4*f*, and falls into the pit 4*c* at the rear side T2. When the drawer 3 is pulled out of the frame 1, the guide projection 6 moves out of the pit 4*c* at the rear side T2, slides horizontally along the horizontal portion 4*f*, passes by the peak 4*d*, descends along the slope 4*e*, and falls into the pit 4*b* at the front side.

Referring to FIGS. 13 and 14, the fitting recesses 8 are formed in the front and rear sides of the upper surface of the top plate 2 that covers the upper side of the uppermost frame 1. Each fitting recess 8 is an elongated groove including the two ends 8*a*. The fitting projections 9 are formed in the front and rear sides of the outer surface of the bottom plate 1*a* of each frame 1. The fitting projections 9 may be fitted in a movable manner into the fitting recesses 8 of another frame 1.

In the same manner as the first embodiment, in the second embodiment, each of the drawers 3 are pulled out of and pushed into the corresponding frame 1 with the outer surfaces of the left and right side plates 3*c* sliding along and guided by the guide walls 5, and the guide projections 6 sliding along and guided by the grooved rails 4. This allows each drawer 3 to be easily pulled out of and pushed into the corresponding frame 1 and improves convenience.

In the second embodiment, the groove surface 4*a* of each grooved rail 4 includes the pits 4*b* and 4*c* at the front side T1 and the rear side T2 in the moving direction T of the corresponding drawer 3. The pits 4*b* and 4*c* can receive the corresponding guide projection 6. The peak 4*d* is formed in the middle portion between the pits 4*b* and 4*c* at the front side T1 and rear side T2 of the moving direction T. The slope 4*e* is formed in the groove surface 4*a* from the pit 4*b* at the front side T1 to the peak 4*d*. The slope 4*e* ascends from the front side T1 to the rear side T2. The horizontal portion 4*f* of the groove surface 4*a* extends from the peak 4*d* to the pit 4*c* at the rear side T2. When the corresponding drawer 3 is pushed into the frame 1, the corresponding guide projection 6 moves out of the pit 4*b* at the front side T1, ascends along the slope 4*e*, passes by the peak 4*d*, slides horizontally along the horizontal portion 4*f*, and falls into the pit 4*c* at the rear side T2. When the drawer 3 is pulled out of the frame 1, the guide projection 6 moves out of the pit 4*c* at the rear side T2, slides horizontally along the horizontal portion 4*f*, passes by the peak 4*d*, descends along the slope 4*e*, and falls into the pit 4*b* at the front side. Accordingly, when pushing the drawer 3 into the frame 1, the user pushes the drawer 3 with a relatively strong force as the guide projections 6 move out the pits 4*b* at the front side T1 and advance to the middle portion. Then, the user pushes the drawer 3 with a light force as the guide projections 6 move horizontally until the guide projections 6 fall into the pits 4*c* at the rear side T2. When pulling the drawer 3 out of the frame 1, the user pulls the drawer 3 with a light force and horizontally moves the projections 6 to the middle portion. Then, the user pulls the drawer 3 with a lighter force as the guide projections 6 descend along the slopes 4*e* until the guide projections 6 fall into the pits 4*b* at the front side T1. When pushing the drawer 3 into the frame 1, the projections 6 ascend along the slopes 4*e* and then slide horizontally. This allows the user to easily move the drawer 3 into the frame 1. Further, the guide projections 6 that slide along the horizontal portions 4*f* suddenly fall into the pits 4*c* at the rear side T2. This allows the user to recognize that the drawer 3 has been completely moved into the drawer 3. Moreover, the guide projections 6 fall into the pits 4*b* or 4*c* and ensures that the drawer 3 is positioned at a fully pulled out end position or a fully pushed in end position. Further, since the guide projections 6 fall into the pits at the fully pulled out end position, the drawer 3 does not fall out of the front side of the frame 1 regardless of the condition in which the frame 1 is set, the condition of the contents stored in the drawer 3, and the application of external force. In addition, when pulling the drawer 3 out of the frame 1, the guide projections 6 descend along the slopes 4*e* from the middle portion. Thus, the drawer 3 may be easily moved. In this manner, the convenience and safety of the storage case is improved.

In the second embodiment, as shown in FIGS. 13 and 14, the fitting recesses 8 are formed in the front and rear sides of the upper surface of the top plate 2, which is made of a synthetic resin. The fitting recesses 8 are elongated grooves, each including the two ends 8*a*. The fitting projections 9 are formed in the front and rear sides of the outer surface of the bottom plate 1*a* of the frame 1. The fitting projections 9 may be fitted in a movable manner into the fitting recesses 8 of another frame 1. Thus, when stacking the plurality of frames 1, the fitting projections 9 of one frame 1 are fitted to the fitting recesses 8 of another frame 1. This restricts displacement of the upper frame 1 in the front, rear, left, and right direction and increases the stacking stability. Further, when stacking storage cases having different widths, the layout of the storage cases may be freely changed in a direction orthogonal to the moving direction T of the drawer. This improves the freedom of layout so that the layout of the storage cases can be freely changed in accordance with the usage, the set positions, the stored contents, and the like. Thus, the freedom is increased for the positions where the storage cases are used and the application of the storage cases.

The present invention is not restricted to the foregoing description. For example, the size, number, and structure of the frames 1 and the drawers 3 may be determined in accordance with the application.

As described above, the present invention achieves its object.

The invention claimed is:

1. A storage case comprising:

a frame made of a synthetic resin and including a bottom plate, left and right side plates, a rear plate, an open front side, and an open upper side;

a top plate made of a synthetic resin, wherein the top plate covers the upper side of the frame; and a drawer made of a synthetic resin and including a bottom plate, a front plate, left and right side plates, a rear plate, and an open upper opening, wherein the drawer is movable through the open front side of the frame;

wherein the bottom plate of the frame includes grooved rails and guide walls, the grooved rails are respectively formed at left and right sides of an inner surface of the bottom plate, the guide walls are respectively formed at left and right sides of the inner surface of the bottom plate outward from the corresponding grooved rails so that outer surfaces of the left and right side plates of the drawer are slidable along the guide walls; and the bottom plate of the drawer includes guide projections formed at rear left and right sides of an outer surface of the bottom plate, and the guide projections are respectively fitted to the left and right grooved rails so that the guide projections are movable along the left and right grooved rails, wherein each of the grooved rails includes a groove surface, the groove surface includes pits, a middle portion, a peak, a slope, and a horizontal portion, the pits are respectively located at a front side and a rear side of the grooved rails in a moving direction of the drawer, the middle portion extends along the groove surface between the pit at the front side and the pit at the rear side, the peak is located in the middle portion, the slope extends along the groove surface from the pit at the front side to the peak and ascends from the front side toward the rear side, the horizontal portion extends along the groove surface from the peak to the pit at the rear side, when the drawer is pushed into the frame, each of the guide projections moves out of the pit at the front side in the groove surface of the corresponding one of the groove rails, ascends along the slope, passes by the peak, moves horizontally along the horizontal portion, and then falls into the pit at the rear side, and when the drawer is pulled out of the frame, each of the guide projections moves out of the pit at the rear side in the groove surface of the corresponding one of the groove rails, moves horizontally along the horizontal portion, passes by the peak, descends along the slope, and then falls into the pit at the front side.

2. A storage case comprising:

a plurality of frames stackable upon one another, wherein the frames are each made of a synthetic resin and include a bottom plate, left and right side plates, a rear plate, an open front side, and an open upper side;

a top plate made of a synthetic resin, wherein the top plate covers the upper side of an uppermost one of the frames; and a drawer made of a synthetic resin and including a bottom plate, a front plate, left and right side plates, a rear plate, and an open upper opening, wherein the drawer is movable through the open front side of each of the frames;

wherein the bottom plate of each of the frames includes grooved rails and guide walls, the grooved rails are respectively formed at left and right sides of an inner surface of the bottom plate of each of the frames, the guide walls are respectively formed at left and right sides of the inner surface of the bottom plate of each of the frames outward from the corresponding grooved rails so that outer surfaces of the left and right side plates of the drawer are slidable along the guide walls; and the bottom plate of each of the drawers includes guide projections formed at rear left and right sides of an outer surface of the bottom plate, and the guide projections are respectively fitted to the left and right grooved rails so that the guide projections are movable along the left and right grooved rails, wherein each of the grooved rails includes a groove surface, the groove surface includes pits, a middle portion, a peak, a slope, and a horizontal portion, the pits are respectively located at a front side and a rear side of the grooved rails in a moving direction of the drawer, the middle portion extends along the groove surface between the pit at the front side and the pit at the rear side, the peak is located in the middle portion, the slope extends along the groove surface from the pit at the front side to the peak and ascends from the front side toward the rear side, the horizontal portion extends along the groove surface from the peak to the pit at the rear side, when the drawer is pushed into the frame, each of the guide projections moves out of the pit at the front side in the groove surface of the corresponding one of the groove rails, ascends along the slope, passes by the peak, moves horizontally along the horizontal portion, and then falls into the pit at the rear side, and when the drawer is pulled out of the frame, each of the guide projections moves out of the pit at the rear side in the groove surface of the corresponding one of the groove rails, moves horizontally along the horizontal portion, passes by the peak, descends along the slope, and then falls into the pit at the front side.

* * * * *